US009688079B2

(12) United States Patent
Liu

(10) Patent No.: US 9,688,079 B2
(45) Date of Patent: Jun. 27, 2017

(54) SYSTEM AND METHOD FOR IMAGE RECEIVING SURFACE TREATMENT IN AN INDIRECT INKJET PRINTER

(71) Applicant: Xerox Corporation, Norwalk, CT (US)

(72) Inventor: Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/791,937

(22) Filed: Jul. 6, 2015

(65) Prior Publication Data

US 2017/0008306 A1 Jan. 12, 2017

(51) Int. Cl.
*B41J 11/00* (2006.01)
*B41J 2/01* (2006.01)

(52) U.S. Cl.
CPC ..... *B41J 11/002* (2013.01); *B41J 2/01* (2013.01); *B41J 2002/012* (2013.01)

(58) Field of Classification Search
CPC ..... B41J 11/002; B41J 2/01; B41J 2002/012
See application file for complete search history.

(56) References Cited

U.S. PATENT DOCUMENTS

| | | | |
|---|---|---|---|
| 4,035,214 | A | 7/1977 | Shuppert et al. |
| 4,135,960 | A | 1/1979 | Shuppert et al. |
| 4,673,303 | A | 6/1987 | Sansone et al. |
| 5,623,296 | A | 4/1997 | Fujino et al. |
| 5,750,314 | A | 5/1998 | Fromson et al. |
| 6,059,407 | A | 5/2000 | Komatsu et al. |
| 6,335,978 | B1 | 1/2002 | Moscato et al. |
| 6,357,870 | B1 | 3/2002 | Beach et al. |
| 6,709,096 | B1 | 3/2004 | Beach et al. |
| 6,713,160 | B2 | 3/2004 | Kitamura et al. |
| 7,281,790 | B2 | 10/2007 | Mouri et al. |
| 7,686,445 | B2 | 3/2010 | Fioravanti et al. |
| 7,869,099 | B2 | 1/2011 | Mashtare |
| 8,011,781 | B2 | 9/2011 | Taniuchi et al. |
| 8,025,389 | B2 | 9/2011 | Yamanobe et al. |
| 8,132,885 | B2 | 3/2012 | Ramakrishnan et al. |
| 2002/0196321 | A1 | 12/2002 | Katsuki |
| 2007/0285486 | A1 | 12/2007 | Harris et al. |
| 2008/0032072 | A1 | 2/2008 | Taniuchi et al. |
| 2011/0234729 | A1 | 9/2011 | Noguchi |

(Continued)

FOREIGN PATENT DOCUMENTS

| | | | |
|---|---|---|---|
| EP | 0 583 168 | B1 | 10/1998 |
| EP | 1 919 711 | B1 | 11/2010 |

(Continued)

*Primary Examiner* — Henok Legesse
(74) *Attorney, Agent, or Firm* — Maginot Moore & Beck LLP

(57) ABSTRACT

An inkjet printer applies a layer of a hydrophilic composition, which includes a liquid carrier, a humectant with a high boiling point, and an absorption agent, to an image receiving surface of an indirect image receiving member. A dryer in the printer removes a portion of the liquid carrier from the layer of hydrophilic composition to form a dried layer of an absorption agent on the image receiving surface and an aqueous ink image is formed on the dried layer. The aqueous ink image and the dried layer are transferred to a surface of a print medium as the aqueous ink image, the dried layer of the hydrophilic composition with the humectant, and print medium move through a transfix nip formed between the indirect image receiving member and a transfix member.

24 Claims, 10 Drawing Sheets

(56) References Cited

U.S. PATENT DOCUMENTS

| | | | |
|---|---|---|---|
| 2012/0013694 | A1 | 1/2012 | Kanke |
| 2013/0127965 | A1 | 5/2013 | Kushida et al. |
| 2013/0127966 | A1 | 5/2013 | Noguchi et al. |

FOREIGN PATENT DOCUMENTS

| | | | |
|---|---|---|---|
| JP | 2767796 | B2 | 6/1998 |
| JP | 3169634 | A | 5/2001 |
| JP | 2001-212956 | A | 8/2001 |
| JP | 4006374 | B2 | 11/2001 |
| JP | 2002-138228 | A | 5/2002 |
| JP | 3379558 | B2 | 2/2003 |
| WO | 93/17000 | A1 | 4/1993 |
| WO | 2011-014185 | A1 | 2/2011 |

SYSTEM AND METHOD FOR IMAGE RECEIVING SURFACE TREATMENT IN AN INDIRECT INKJET PRINTER

TECHNICAL FIELD

This disclosure relates generally to aqueous indirect inkjet printers, and, in particular, to surface preparation for aqueous inkjet printing.

BACKGROUND

In general, inkjet printing machines or printers include at least one printhead that ejects drops or jets of liquid ink onto a recording or image forming surface. An aqueous inkjet printer employs water-based or solvent-based inks in which pigments or other colorants are suspended or in solution. Once the aqueous ink is ejected onto an image receiving surface by a printhead, the water or solvent is evaporated to stabilize the ink image on the image receiving surface. When aqueous ink is ejected directly onto media, the aqueous ink tends to soak into the media when it is porous, such as paper, and change the physical properties of the media. Because the spread of the ink droplets striking the media is a function of the media surface properties and porosity, the print quality can be inconsistent. To address this issue, indirect printers have been developed that eject ink onto a blanket mounted to a drum or endless belt. The ink is dried on the blanket and then transferred to media. Such a printer avoids the changes in image quality, drop spread, and media properties that occur in response to media contact with the water or solvents in aqueous ink. Indirect printers also reduce the effect of variations in other media properties that arise from the use of widely disparate types of paper and films used to hold the final ink images.

In aqueous ink indirect printing, an aqueous ink is ejected onto an intermediate imaging surface, typically called a blanket, and the ink is partially dried on the blanket prior to transfixing the image to a media substrate, such as a sheet of paper. To ensure excellent print quality, the ink drops on the blanket must spread and not coalesce prior to drying. Otherwise, the ink images appear grainy and have deletions. The lack of spreading can also cause missing or failed inkjets in the printheads to produce streaks in the ink image. Spreading of aqueous ink is facilitated by materials having a high energy surface. In order to facilitate transfer of the ink image from the blanket to the media substrate, however, a blanket having a surface with a relatively low surface energy is preferred. These diametrically opposed and competing properties for a blanket surface make selections of materials for blankets difficult. Reducing ink drop surface tension helps, but the spread is still generally inadequate for appropriate image quality. Offline oxygen plasma treatments of blanket materials that increase the surface energy of the blanket have been tried and shown to be effective. The benefit of such offline treatment may be short lived due to surface contamination, wear, and aging over time.

One challenge confronting indirect aqueous inkjet printing processes relates to the spread of ink drops during the printing process. Indirect image receiving members are formed from low surface energy materials that promote the transfer of ink from the surface of the indirect image receiving member to the print medium that receives the final printed image. Low surface energy materials, however, also tend to promote the "beading" of individual ink drops on the image receiving surface. Since a printer partially dries the aqueous ink drops prior to transferring the ink drops to the print medium, the aqueous ink does not have an opportunity to spread during the printing process. The resulting printed image may appear to be grainy and solid lines or solid printed regions are reproduced as a series of dots instead of continuous features in the final printed image. To address these issues, a surface maintenance unit in an aqueous inkjet printer applies a layer of a hydrophilic composition comprising a liquid carrier and an absorption agent to the image receiving surface. A dryer is positioned and configured to remove at least a portion of the liquid carrier from the layer of hydrophilic composition after the surface maintenance unit has applied the hydrophilic composition to the image receiving surface to form a dried layer of the absorption agent. After a plurality of inkjets ejects aqueous ink onto the dried layer to form an aqueous ink image on the image receiving surface, a transfix member engages the image receiving member to form a transfix nip and apply a pressure to a print medium moving through the transfix nip to transfix the aqueous ink image and at least a portion of the dried layer to a surface of the print medium.

This aqueous inkjet printer generally works well; however, some print jobs present issues that impact the transfixing of the ink image to the media in the nip. Specifically, regulation of the dryers and heaters in printers configured as described above evaporate water from the hydrophilic composition and ink with reference to a density of the ink on the blanket. Issues can arise when the ink image on the blanket has varying densities of ink. For example, some images have areas that are relatively solid, that is, each pixel in the area has colorant in it, while other areas are halftone, that is, some percentage, such as fifty percent, of the pixels in the area have colorant and the remaining pixels are empty of ink. If the dryers and heaters are controlled to ensure the solid areas are appropriately dried, then the halftone areas may be completely dried. Consequently, the solid areas of the image are likely to transfer well, but the halftone areas only partially transfer, if at all. The resulting dropout of colorant in the image adversely impacts the overall image quality. Being able to preserve the advantages of the hydrophilic composition and enabling all areas of an ink image to transfer to the media regardless of the ink density would be beneficial.

SUMMARY

In one embodiment, an indirect inkjet printer uses a hydrophilic composition that includes a high boiling point humectant to enable the hydrophilic composition to transfer to the media and move all the areas of the ink image to the media regardless of the density of the ink in each area. The printer includes an indirect image receiving member having an image receiving surface configured to move in a process direction in the inkjet printer, a surface maintenance unit configured to apply a layer of a hydrophilic composition comprising a liquid carrier, a humectant, and an absorption agent to the image receiving surface, a dryer positioned and configured to direct air having a temperature that is below a boiling point of the humectant towards the image receiving surface to remove at least a portion of the liquid carrier from the layer of hydrophilic composition after the surface maintenance unit has applied the hydrophilic composition to the image receiving surface to form a dried layer of the absorption agent, a plurality of inkjets configured to eject aqueous ink onto the dried layer to form an aqueous ink image on the image receiving surface, and a transfix member that engages the image receiving member to form a transfix nip, the transfix member being configured to apply pressure to a print medium moving through the transfix nip as the aqueous ink image on the dried layer moves through the transfix nip to transfix the aqueous ink image, the dried layer that receives the aqueous ink, and the dried layer with the humectant to a surface of the print medium.

In another embodiment, a method for operating an indirect inkjet printer using aqueous inks and a hydrophilic composition that includes a high boiling point humectant to enable the hydrophilic composition to transfer to the media and move all the areas of the ink image to the media regardless of the density of the ink in each area. The method includes moving an image receiving surface of an indirect image receiving member in a process direction through the inkjet printer past a surface maintenance unit, a dryer, a plurality of inkjets, and a transfix nip, applying a layer of hydrophilic composition comprising a liquid carrier, a humectant, and an absorption agent to the image receiving surface with the surface maintenance unit, drying the layer of hydrophilic composition with air from the dryer having a temperature that is below a boiling point of the humectant to remove at least a portion of the liquid carrier from the layer of the hydrophilic composition to form a dried layer of the absorption agent on the image receiving surface, ejecting ink drops of an aqueous ink with the plurality of inkjets to form an aqueous ink image on the dried layer, and applying pressure with a transfix member to the image receiving surface of the indirect image receiving member to transfix the aqueous ink image, the dried layer that receives the aqueous ink, and the dried layer with the humectant to a surface of a print medium moving through the transfix nip between the transfix member and the indirect image receiving member.

DETAILED DESCRIPTION

Figure 1:
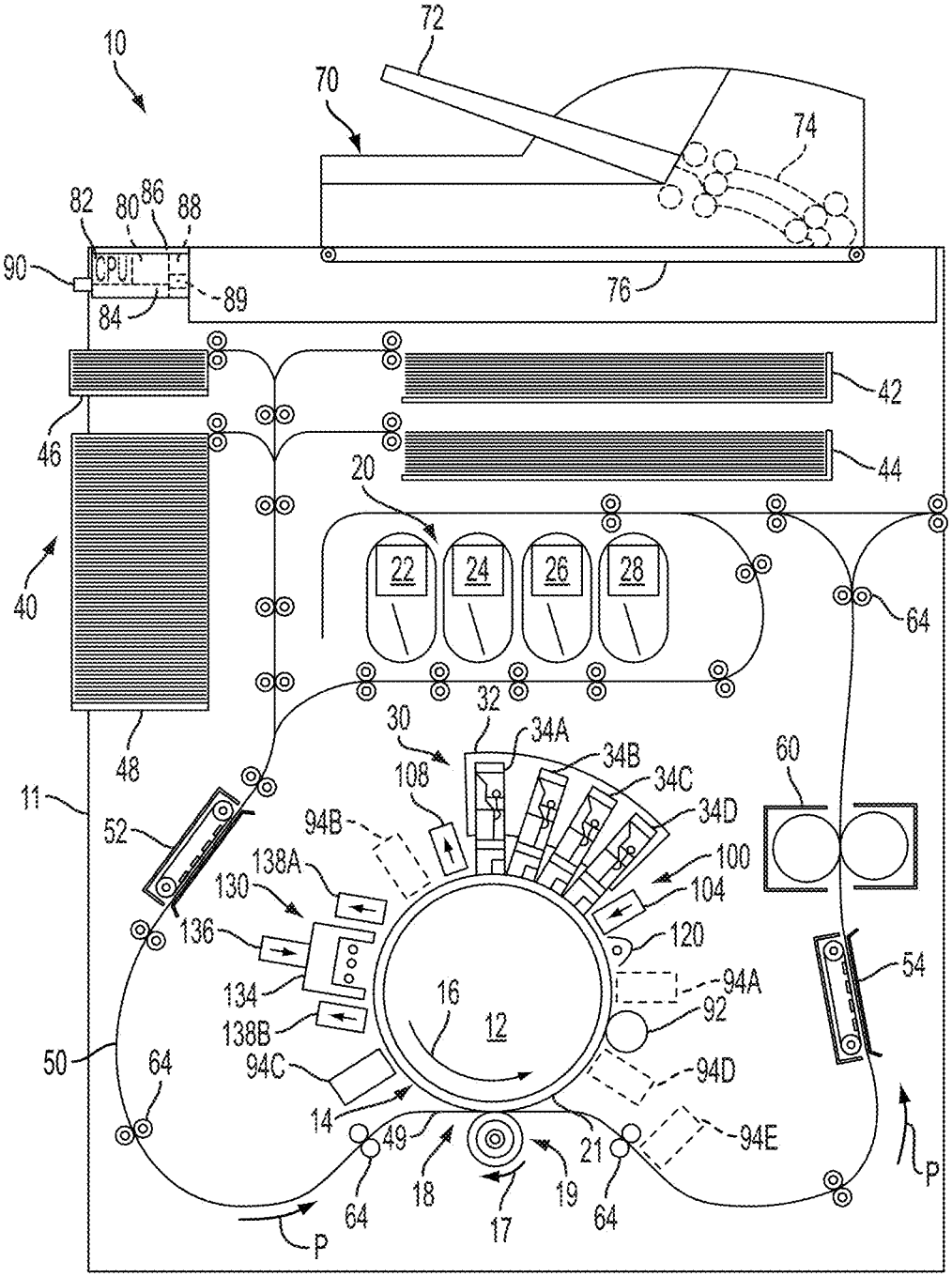
FIG. 1 is a schematic drawing of an aqueous indirect inkjet printer that prints sheet media.

For a general understanding of the present embodiments, reference is made to the drawings. In the drawings, like reference numerals have been used throughout to designate like elements. As used herein, the terms "printer," "printing device," or "imaging device" generally refer to a device that produces an image on print media with aqueous ink and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Aqueous inkjet printers use inks that have a high percentage of water relative to the amount of colorant and/or solvent in the ink.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as an intermediate imaging surface, moves past the printheads in a process direction through the print zone. The inkjets in the printheads eject ink drops in rows in a cross-process direction, which is perpendicular to the process direction across the image receiving surface. As used in this document, the term "aqueous ink" includes liquid inks in which colorant is in a solution, suspension or dispersion with a liquid solvent that includes water and/or one or more liquid solvents. The terms "liquid solvent" or more simply "solvent" are used broadly to include compounds that may dissolve colorants into a solution, or that may be a liquid that holds particles of colorant in a suspension or dispersion without dissolving the colorant.

As used herein, the term "hydrophilic" refers to any composition or compound that attracts water molecules or other solvents used in aqueous ink. As used herein, a reference to a hydrophilic composition refers to a liquid carrier that carries a hydrophilic absorption agent. Examples of liquid carriers include, but are not limited to, a liquid, such as water or alcohol, that carries a dispersion, suspension, or solution of an absorption agent. A dryer then removes at least a portion of the liquid carrier and the remaining solid or gelatinous phase absorption agent has a high surface energy to absorb a portion of the water in aqueous ink drops while enabling the colorants in the aqueous ink drops to spread over the surface of the absorption agent. As used herein, a reference to a dried layer of the absorption agent refers to an arrangement of a hydrophilic compound after all or a substantial portion of the liquid carrier has been removed from the composition through a drying process. As described in more detail below, an indirect inkjet printer forms a layer of a hydrophilic composition on a surface of an image receiving member using a liquid carrier, such as water, to apply a layer of the hydrophilic composition. The liquid carrier is used as a mechanism to convey an absorption agent in the liquid carrier to an image receiving surface to form a uniform layer of the hydrophilic composition on the image receiving surface.

As used herein, the term "absorption agent" refers to a material that is part of the hydrophilic composition, that has hydrophilic properties, and that is substantially insoluble to water and other solvents in aqueous ink during a printing process after the printer dries the absorption agent into a dried layer or "skin" that covers the image receiving surface. The printer dries the hydrophilic composition to remove all or a portion of the liquid carrier to form a dried "skin" of the absorption agent on the image receiving surface. The dried layer of the absorption agent has a high surface energy with respect to the ink drops that are ejected onto the image receiving surface. The high surface energy promotes spreading of the ink on the surface of the dried layer, and the high surface energy holds the aqueous ink in place on the moving image receiving member during the printing process.

When aqueous ink drops contact the absorption agent in the dried layer, the absorption agent absorbs a portion of the water and other solvents in the aqueous ink drop. The absorption agent in the portion of the dried layer that absorbs the water and swells, but remains substantially intact during the printing operation and does not dissolve. The absorption agent in portions of the dried layer that do not contact aqueous ink has a comparatively high adhesion to the image receiving surface and a comparatively low adhesion to a print medium, such as paper. The portions of the dried layer that absorb water and solvents from the aqueous ink have a lower adhesion to the image receiving surface, and prevent colorants and other highly adhesive components in the ink from contacting the image receiving surface. Thus, the absorption agent in the dried layer promotes the spread of the ink drops to form high quality printed images, holds the aqueous ink in position during the printing process, promotes the transfer of the latent ink image from the image receiving member to paper or another print medium, and promotes the separation of the print medium from the image receiving surface after the aqueous ink image has been transferred to the print medium.

As is described in more detail in co-pending U.S. application Ser. No. 14/033,093 and Ser. No. 14/033,042, the layer of the hydrophilic composition is formed from a material, such as starch or polyvinyl acetate, which is dispersed, suspended, or dissolved in a liquid carrier such as water. To address the variations in the degree of dryness of the composition caused by different levels of dryer operation, the composition also includes a high percentage of a humectant having a high boiling point. As used in this document, "humectant" refers to a hygroscopic substance that retains water. Also, as used in this document, "high boiling point" refers to a boiling temperature that is significantly greater than the boiling point for water and is at least 25 degrees C. above the boiling point of water. In one embodiment, the humectant is glycerol, although other humectants having similar properties can be used to treat the surface of blanket 21 for improved formation and transfer of ink images. The hydrophilic composition is applied to an image receiving surface as a liquid to enable formation of a uniform layer on the image receiving surface. The printer dries the hydrophilic composition to remove at least a portion of the liquid carrier from the hydrophilic composition, although the humectant remains in the composition, to form a dried layer of solid, semi-solid, highly viscous or gel-like absorption agent.

FIG. 1 illustrates a high-speed aqueous ink image producing machine or printer 10. As illustrated, the printer 10 is an indirect printer that forms an ink image on a surface of a blanket 21 mounted about an intermediate rotating member 12 and then transfers the ink image to media passing through a nip 18 formed between the blanket 21 and the transfix roller 19. The surface 14 of the blanket 21 is referred to as the image receiving surface of the blanket 21 and the rotating member 12 since the surface 14 receives a hydrophilic composition that includes the humectant and the aqueous ink images that are transfixed to print media during a printing process. A print cycle is now described with reference to the printer 10. As used in this document, "print cycle" refers to the operations of a printer to prepare an imaging surface for printing, ejection of the ink onto the prepared surface, treatment of the ink on the imaging surface to stabilize and prepare the image for transfer to media, and transfer of the image from the imaging surface to the media.

The printer 10 includes a frame 11 that supports directly or indirectly operating subsystems and components, which are described below. The printer 10 includes an indirect image receiving member, which is illustrated as rotating imaging drum 12 in FIG. 1, but can also be configured as a supported endless belt. The imaging drum 12 has an outer blanket 21 mounted about the circumference of the drum 12. The blanket moves in a direction 16 as the member 12 rotates. A transfix roller 19 rotatable in the direction 17 is loaded against the surface of blanket 21 to form a transfix nip 18, within which ink images formed on the surface of blanket 21 are transfixed onto a media sheet 49. In some embodiments, a heater in the drum 12 (not shown) or in another location of the printer heats the image receiving surface 14 on the blanket 21 to a temperature in a range of approximately of 50° C. to 70° C. The elevated temperature promotes partial drying of the liquid carrier that is used to deposit the hydrophilic composition and of the water in the aqueous ink drops that are deposited on the image receiving surface 14 without reaching the boiling point of the humectant so it remains in the composition.

The blanket is formed of a material having a relatively low surface energy to facilitate transfer of the ink image from the surface of the blanket 21 to the media sheet 49 in the nip 18. Such materials include silicones, fluoro-silicones, Viton, and the like. A surface maintenance unit (SMU) 92 removes residual ink and hydrophilic composition left on the surface of the blanket 21 after the ink images are transferred to the media sheet 49. The low energy surface of the blanket does not aid in the formation of good quality ink images because such surfaces do not spread ink drops as well as high energy surfaces. Consequently, the SMU 92 applies a coating of a hydrophilic composition with the high boiling point humectant to the image receiving surface 14 on the blanket 21. This hydrophilic composition aids in spreading aqueous ink drops on the image receiving surface, inducing solids to precipitate out of the liquid ink, and aiding in the release of the ink image from the blanket. The high boiling point humectant helps the composition layer to remain sufficiently tacky such that the layer formed by the composition also transfers to the media as well.

Figure 4:
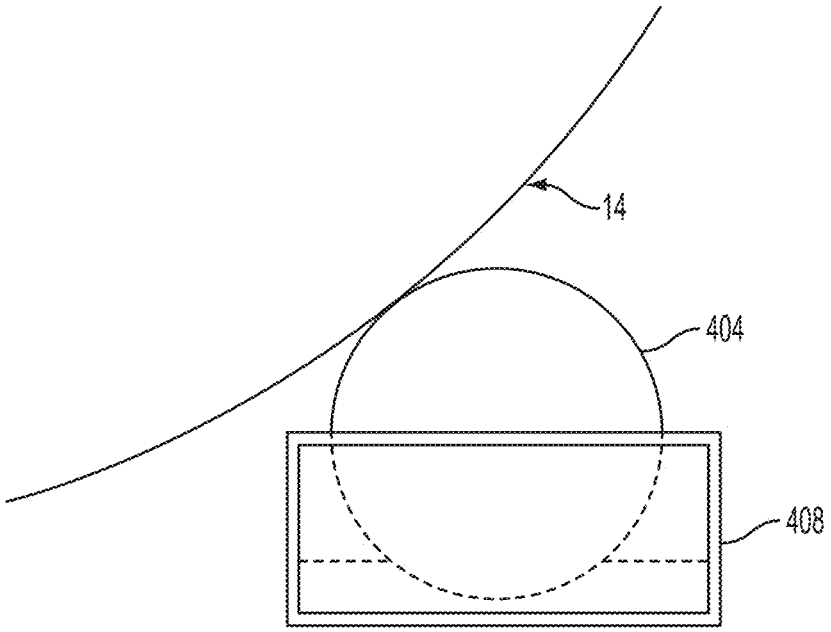
FIG. 4 is a schematic drawing of a surface maintenance unit that applies a hydrophilic composition that includes a high boiling point humectant to a surface of an indirect image receiving member in an inkjet printer.

In one embodiment that is depicted in FIG. 4, the SMU 92 includes a coating applicator, such as a donor roller 404, which is partially submerged in a reservoir 408 that holds a hydrophilic composition and humectant in a liquid carrier. The donor roller 404 rotates in response to the movement of the image receiving surface 14 in the process direction. The donor roller 404 draws the liquid hydrophilic composition from the reservoir 408 and deposits a layer of the hydrophilic composition on the image receiving surface 14. As described below, the hydrophilic composition is deposited as a uniform layer with a thickness of approximately 1 μm to 10 μm. The SMU 92 deposits the hydrophilic composition on the image receiving surface 14 to form a uniform distribution of the absorption agent in the liquid carrier of the hydrophilic composition. After a drying process, the dried layer forms a "skin" of the absorption agent that substantially covers the image receiving surface 14 before the printer ejects ink drops during a print process. In some illustrative embodiments, the donor roller 404 is an anilox roller or an elastomeric roller made of a material, such as rubber. The SMU 92 is operatively connected to a controller 80, described in more detail below, to enable the controller to operate the donor roller, metering blade and cleaning blade selectively to deposit and distribute the hydrophilic composition onto the surface of the blanket and remove un-transferred ink pixels from the surface of the blanket 21.

The printers 10 and 200 include a dryer 96 that emits heat and optionally directs an air flow toward the hydrophilic composition that is applied to the image receiving surface 14. The dryer 96 facilitates the evaporation of at least a portion of the liquid carrier from the hydrophilic composition to leave a dried layer of absorption agent on the image receiving surface 14 before the image receiving member passes the printhead modules 34A-34D to receive the aqueous printed image; however, the humectant remains in solution.

The printers 10 and 200 include an optical sensor 94A, also known as an image-on-drum ("IOD") sensor, which is configured to detect light reflected from the blanket surface 14 and the coating applied to the blanket surface as the member 12 rotates past the sensor. The optical sensor 94A includes a linear array of individual optical detectors that are arranged in the cross-process direction across the blanket 21. The optical sensor 94A generates digital image data corresponding to light that is reflected from the blanket surface 14 and the coating. The optical sensor 94A generates a series of rows of image data, which are referred to as "scanlines," as the image receiving member 12 rotates the blanket 21 in the direction 16 past the optical sensor 94A. In one embodiment, each optical detector in the optical sensor 94A further comprises three sensing elements that are sensitive to wavelengths of light corresponding to red, green, and blue (RGB) reflected light colors. Alternatively, the optical sensor 94A includes illumination sources that shine red, green, and blue light or, in another embodiment, the sensor 94A has an illumination source that shines white light onto the surface of blanket 21 and white light detectors are used. The optical sensor 94A shines complementary colors of light onto the image receiving surface to enable detection of different ink colors using the photodetectors. The image data generated by the optical sensor 94A are analyzed by the controller 80 or other processor in the printers 10 and 200 to identify the thickness of the coating on the blanket and the area coverage. The thickness and coverage can be identified from either specular or diffuse light reflection from the blanket surface and/or coating. Other optical sensors, such as 94B, 94C, and 94D, are similarly configured and can be located in different locations around the blanket 21 to identify and evaluate other parameters in the printing process, such as missing or inoperative inkjets and ink image formation prior to image drying (94B), ink image treatment for image transfer (94C), and the efficiency of the ink image transfer (94D). Alternatively, some embodiments can include an optical sensor to generate additional data that can be used for evaluation of the image quality on the media (94E).

The printer 10 includes an airflow management system 100, which generates and controls a flow of air through the print zone. The airflow management system 100 includes a printhead air supply 104 and a printhead air return 108. The printhead air supply 104 and return 108 are operatively connected to the controller 80 or some other processor in the printer 10 to enable the controller to manage the air flowing through the print zone. This regulation of the air flow can be through the print zone as a whole or about one or more printhead arrays. The regulation of the air flow helps prevent evaporated solvents and water in the ink from condensing on the printhead and helps attenuate heat in the print zone to reduce the likelihood that ink dries in the inkjets, which can clog the inkjets. The airflow management system 100 can also include sensors to detect humidity and temperature in the print zone to enable more precise control of the temperature, flow, and humidity of the air supply 104 and return 108 to ensure optimum conditions within the print zone. Controller 80 or some other processor in the printer 10 can also enable control of the system 100 with reference to ink coverage in an image area or even to time the operation of the system 100 so air only flows through the print zone when an image is not being printed.

The high-speed aqueous ink printer 10 also includes an aqueous ink supply and delivery subsystem 20 that has at least one source 22 of one color of aqueous ink. Since the illustrated printer 10 is a multicolor image producing machine, the ink delivery system 20 includes four (4) sources 22, 24, 26, 28, representing four (4) different colors CYMK (cyan, yellow, magenta, black) of aqueous inks. In the embodiment of FIG. 1, the printhead system 30 includes a printhead support 32, which provides support for a plurality of printhead modules, also known as print box units, 34A through 34D. Each printhead module 34A-34D effectively extends across the width of the blanket and ejects ink drops onto the surface 14 of the blanket 21. A printhead module can include a single printhead or a plurality of printheads configured in a staggered arrangement. Each printhead module is operatively connected to a frame (not shown) and aligned to eject the ink drops to form an ink image on the coating on the blanket surface 14. The printhead modules 34A-34D can include associated electronics, ink reservoirs, and ink conduits to supply ink to the one or more printheads. In the illustrated embodiment, conduits (not shown) operatively connect the sources 22, 24, 26, and 28 to the printhead modules 34A-34D to provide a supply of ink to the one or more printheads in the modules. As is generally familiar, each of the one or more printheads in a printhead module can eject a single color of ink. In other embodiments, the printheads can be configured to eject two or more colors of ink. For example, printheads in modules 34A and 34B can eject cyan and magenta ink, while printheads in modules 34C and 34D can eject yellow and black ink. The printheads in the illustrated modules are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 10 includes four printhead modules 34A-34D, each of which has two arrays of printheads, alternative configurations include a different number of printhead modules or arrays within a module.

After the printed image on the blanket surface 14 exits the print zone, the image passes under an image dryer 130. The image dryer 130 includes a heater, such as a radiant infrared, radiant near infrared, and a forced hot air convection heater 134, a dryer 136, which is illustrated as a heated air source 136, and air returns 138A and 138B. The infrared heater 134 applies infrared heat to the printed image on the surface 14 of the blanket 21 to evaporate water or solvent in the ink. The heated air source 136 directs heated air over the ink to supplement the evaporation of the water or solvent from the ink. In one embodiment, the dryer 136 is a heated air source with the same design as the dryer 96. While the dryer 96 is positioned along the process direction to dry the hydrophilic composition, the dryer 136 is positioned along the process direction after the printhead modules 34A-34D to partially dry the aqueous ink on the image receiving surface 14. The air is then collected and evacuated by air returns 138A and 138B to reduce the interference of the air flow with other components in the printing area.

As further shown, the printer 10 includes a recording media supply and handling system 40 that stores, for example, one or more stacks of paper media sheets of various sizes. The recording media supply and handling system 40, for example, includes sheet or substrate supply sources 42, 44, 46, and 48. In the embodiment of printer 10, the supply source 48 is a high capacity paper supply or feeder for storing and supplying image receiving substrates in the form of cut media sheets 49, for example. The recording media supply and handling system 40 also includes a substrate handling and transport system 50 that has a media pre-conditioner assembly 52 and a media post-conditioner assembly 54. The printer 10 includes an optional fusing device 60 to apply additional heat and pressure to the print medium after the print medium passes through the transfix nip 18. In the embodiment of FIG. 1, the printer 10 includes an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead modules 34A-34D (and thus the printheads), the substrate supply and handling system 40, the substrate handling and transport system 50, and, in some embodiments, the one or more optical sensors 94A-94E. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead modules 34A-34D. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and generation of the printhead control signals output to the printhead modules 34A-34D. Additionally, the controller 80 determines and/or accepts related subsystem and component controls, for example, from operator inputs via the user interface 86, and accordingly executes such controls. As a result, aqueous ink for appropriate colors are delivered to the printhead modules 34A-34D. Additionally, pixel placement control is exercised relative to the blanket surface 14 to form ink images corresponding to the image data, and the media, which can be in the form of media sheets 49, are supplied by any one of the sources 42, 44, 46, 48 and handled by recording media transport system 50 for timed delivery to the nip 18. In the nip 18, the ink image is transferred from the blanket and coating 21 to the media substrate within the transfix nip 18.

Figure 2:
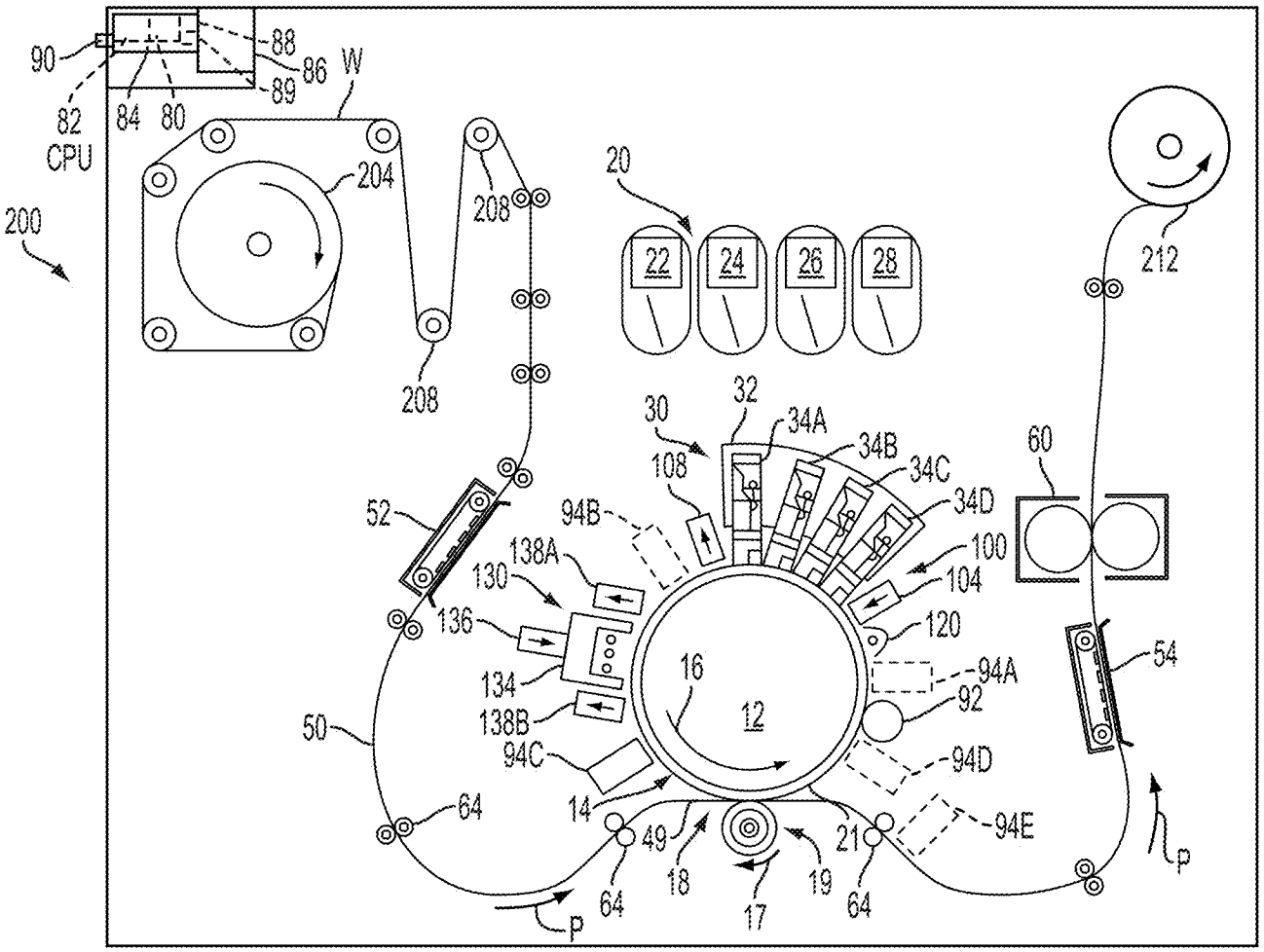
FIG. 2 is a schematic drawing of an aqueous indirect inkjet printer that prints a continuous web.

Although the printer 10 in FIG. 1 and the printer 200 in FIG. 2 are described as having a blanket 21 mounted about an intermediate rotating member 12, other configurations of an image receiving surface can be used. For example, the intermediate rotating member can have a surface integrated into its circumference that enables an aqueous ink image to be formed on the surface. Alternatively, a blanket is configured as an endless belt and rotates as the member 12 is in FIG. 1 and FIG. 2 for formation of an aqueous image. Other variations of these structures can be configured for this purpose. As used in this document, the term "intermediate imaging surface" includes these various configurations.

In some printing operations, a single ink image can cover the entire surface 14 of the blanket 21 (single pitch) or a plurality of ink images can be deposited on the blanket 21 (multi-pitch). In a multi-pitch printing architecture, the surface of the image receiving member can be partitioned into multiple segments, each segment including a full page image in a document zone (i.e., a single pitch) and inter-document zones that separate multiple pitches formed on the blanket 21. For example, a two pitch image receiving member includes two document zones that are separated by two inter-document zones around the circumference of the blanket 21. Likewise, for example, a four pitch image receiving member includes four document zones, each corresponding to an ink image formed on a single media sheet, during a pass or revolution of the blanket 21.

Once an image or images have been formed on the blanket and coating under control of the controller 80, the illustrated inkjet printer 10 operates components within the printer to perform a process for transferring and fixing the image or images from the blanket surface 14 to media. In the printer 10, the controller 80 operates actuators to drive one or more of the rollers 64 in the media transport system 50 to move the media sheet 49 in the process direction P to a position adjacent the transfix roller 19 and then through the transfix nip 18 between the transfix roller 19 and the blanket 21. The transfix roller 19 applies pressure against the back side of the recording media 49 in order to press the front side of the recording media 49 against the blanket 21 and the image receiving member 12. Although the transfix roller 19 can also be heated, in the exemplary embodiment of FIG. 1, the transfix roller 19 is unheated. Instead, the pre-heater assembly 52 for the media sheet 49 is provided in the media path leading to the nip. The pre-conditioner assembly 52 conditions the media sheet 49 to a predetermined temperature that aids in the transferring of the image to the media, thus simplifying the design of the transfix roller. The pressure produced by the transfix roller 19 on the back side of the heated media sheet 49 facilitates the transfixing (transfer and fusing) of the image from the image receiving member 12 onto the media sheet 49. The rotation or rolling of both the image receiving member 12 and transfix roller 19 not only transfixes the images onto the media sheet 49, but also assists in transporting the media sheet 49 through the nip. The image receiving member 12 continues to rotate to enable the printing process to be repeated.

After the image receiving member moves through the transfix nip 18, the image receiving surface passes a cleaning unit that removes residual portions of the absorption agent and small amounts of residual ink from the image receiving surface 14. In the printers 10 and 200, the cleaning unit is embodied as a cleaning blade 95 that engages the image receiving surface 14. The blade 95 is formed from a material that wipes the image receiving surface 14 without causing damage to the blanket 21. For example, the cleaning blade 95 is formed from a flexible polymer material in the printers 10 and 200. As depicted below in FIG. 3, another embodiment has a cleaning unit that includes a roller or other member that applies a mixture of water and detergent to remove residual materials from the image receiving surface 14 after the image receiving member moves through the transfix nip 18. As used herein, the term "detergent" or cleaning agent refers to any surfactant, solvent, or other chemical compound that is suitable for removing the dried portion of the absorption agent and any residual ink that may remain on the image receiving surface from the image receiving surface. One example of a suitable detergent is sodium stearate, which is a compound commonly used in soap. Another example is IPA, which is a common solvent that is very effective to remove ink residues from the image receiving surface.

In the embodiment shown in FIG. 2, like components are identified with like reference numbers used in the description of the printer in FIG. 1. One difference between the printers of FIG. 1 and FIG. 2 is the type of media used. In the embodiment of FIG. 2, a media web W is unwound from a roll of media 204 as needed and a variety of motors, not shown, rotate one or more rollers 208 to propel the media web W through the nip 18 so the media web W can be wound onto a roller 212 for removal from the printer. Alternatively, the media can be directed to other processing stations that perform tasks such as cutting, binding, collating, and/or stapling the media or the like. One other difference between the printers 10 and 200 is the nip 18. In the printer 200, the transfer roller continually remains pressed against the blanket 21 as the media web W is continuously present in the nip. In the printer 10, the transfer roller is configured for selective movement towards and away from the blanket 21 to enable selective formation of the nip 18. Nip 18 is formed in the embodiment of FIG. 1 in synchronization with the arrival of media at the nip to receive an ink image and is separated from the blanket to remove the nip as the trailing edge of the media leaves the nip.

Figure 3:
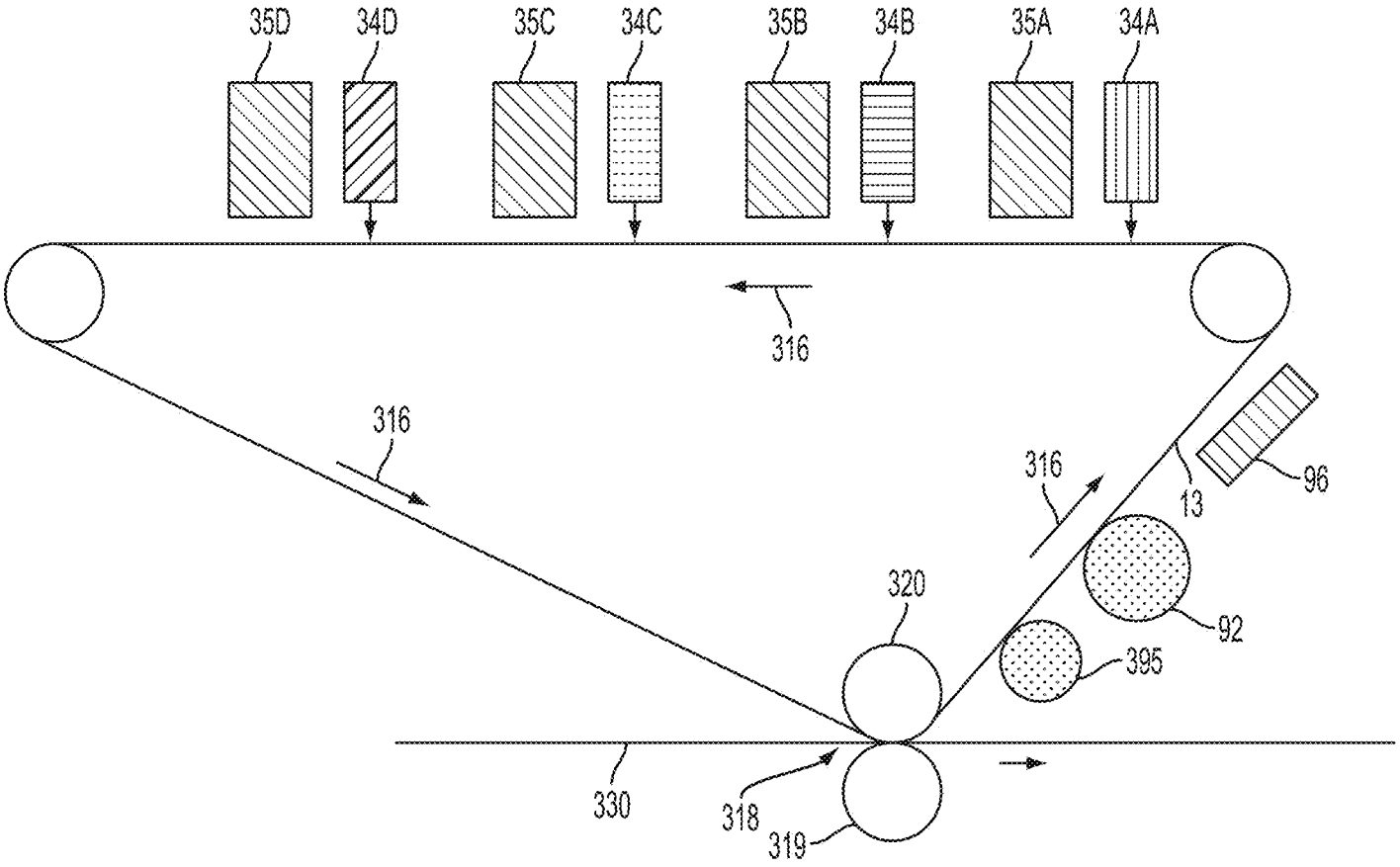
FIG. 3 is a schematic diagram of an inkjet printer that includes an endless belt indirect image receiving member.

FIG. 3 is a simplified schematic diagram of another inkjet printer 300 where the indirect image receive member is in the form of an endless belt 13. The belt 13 moves in a process direction as indicated by the arrows 316 to pass an SMU 92, dryer 96, printhead modules 34A-34D, and ink dryers 35A-35D to receive a dried layer of absorption agent and a latent aqueous ink image that is formed on the dried layer. The belt 13 is formed from a low surface energy material, such as silicone, fluorosilicone, hydrofluoroelastomers, and hybrids and blends of silicone and hydrofluoroelastomers, and the like. In the printer 300, the belt 13 passes between pressure rollers 319 and 319 that form a transfix nip 38. A print medium, such as the media sheet 330, moves through the nip 318 concurrently with the ink image. The ink image and a portion of the absorption agent in the dried layer transfer from the belt 13 to the print medium 330 in the transfix nip 318 to form a printed image. A cleaning unit 395 removes residual portions of the absorption agent in the dried layer from the belt 13 after completion of the transfix operation. While not expressly depicted for simplicity, the printer 300 includes additional components that are similar to the printers 10 and 200 including, but not limited to, a controller, optical sensors, media supplies, a media path, ink reservoirs, and other components that are associated with the handling of ink and print media in an inkjet printer.

Figure 7:
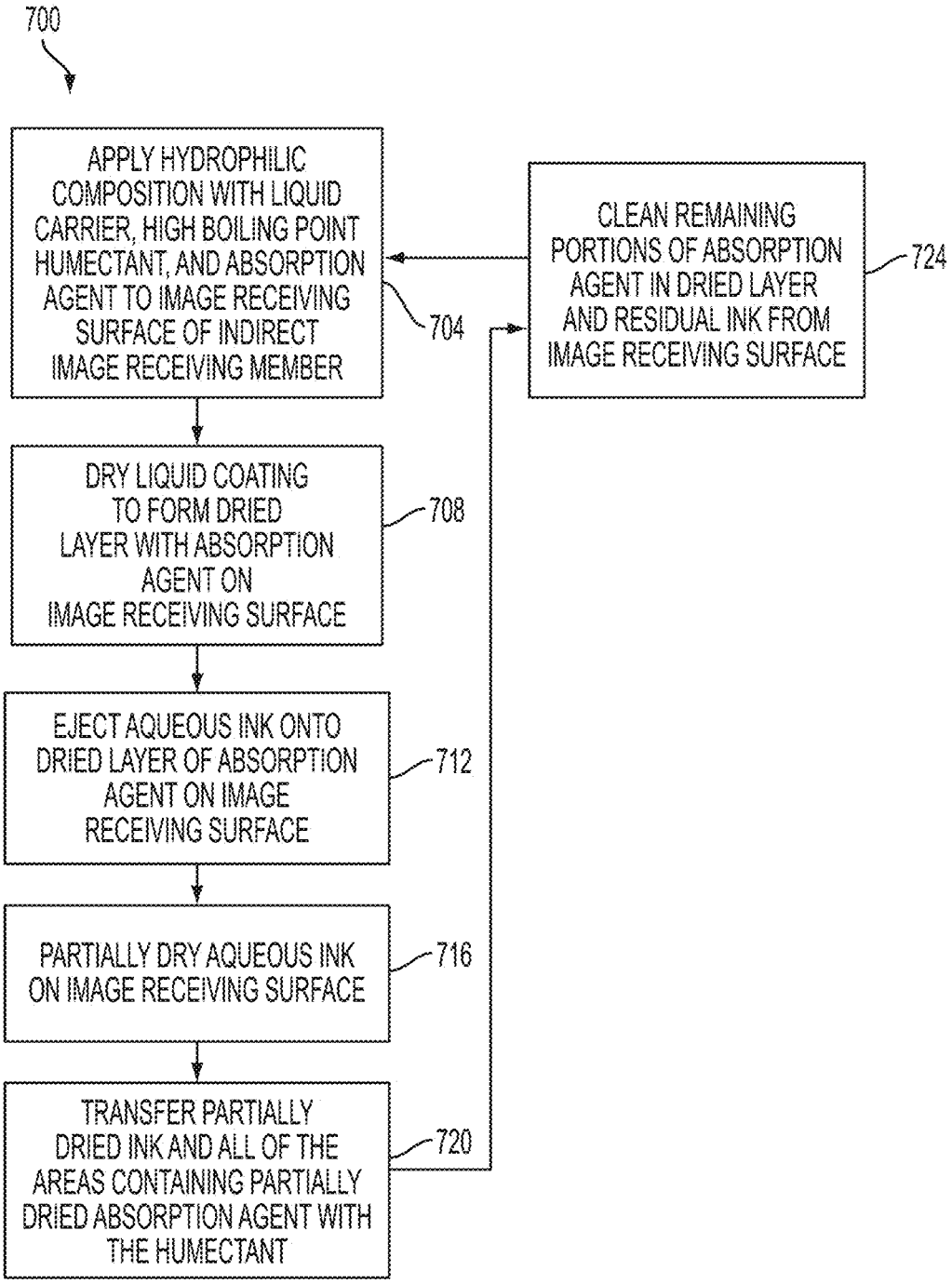
FIG. 7 is a block diagram of a process for printed images in an indirect inkjet printer that uses aqueous inks.

FIG. 7 depicts a process 700 for operating an aqueous indirect inkjet printer using a hydrophilic composition having a high boiling point humectant to form a dried coating or "skin" layer of a dried absorption agent in the hydrophilic composition on an image receiving surface of an indirect image receiving member prior to ejecting liquid ink drops onto the dried layer. In the discussion below, a reference to the process 700 performing an action or function refers to a controller, such as the controller 80 in the printers 10 and 200, executing stored programmed instructions to perform the action or function in conjunction with other components of the printer. The process 700 is described in conjunction with the printers of FIG. 1-FIG. 3 and FIG. 5A-FIG. 5B for illustrative purposes.

Process 700 begins as the printer applies a layer of a hydrophilic composition having a high boiling point humectant with a liquid carrier to the image receiving surface of the image receiving member (block 704). In the printers 10 and 200, the drum 12 and blanket 21 move in the process direction along the indicated circular direction 16 during the process 700 to receive the hydrophilic composition. In the printer 300, the endless belt 13 moves in a loop as indicated by the process direction arrows 316. In the printers 10 and 200, the SMU 92 applies a hydrophilic composition with a liquid carrier to the surface 14 of the imaging drum 12. In the printer 300, the SMU 92 applies the hydrophilic composition to a surface of the imaging belt 13.

Figure 5A:
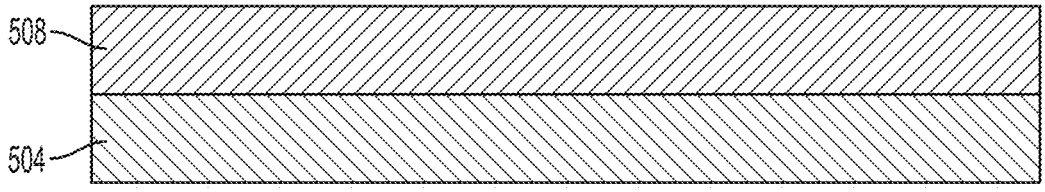
FIG. 5A is a side view of a hydrophilic composition that includes a high boiling point humectant on the surface of an indirect image receiving member in an inkjet printer.

In one embodiment, the liquid carrier is water or another liquid, such as alcohol, which partially evaporates from the image receiving surface and leaves a dried layer of absorption agent on the image receiving surface. In FIG. 5A, the surface of the indirect image receiving member 504 is covered with the hydrophilic composition 508 that contains the high boiling point humectant. The SMU 92 deposits the hydrophilic composition on the image receiving surface 14 of the blanket 21 to form a uniform coating of the hydrophilic composition. A greater coating thickness of the hydrophilic composition enables formation of a uniform layer that completely covers the image receiving surface, but the increased volume of liquid carrier in the thicker coating requires additional drying time or larger dryers to remove the liquid carrier to form a dried layer of the absorption agent. Thinner coatings of the hydrophilic composition require the removal of a smaller volume of the liquid carrier to form the dried layer, but if the coating of hydrophilic composition is too thin, then the coating may not fully cover the image receiving surface. In the embodiments of FIG. 1-FIG. 3, the printers 10, 200, and 300 form the hydrophilic composition having the high boiling point humectant with the liquid carrier on the image receiving surface with a thickness of between approximately 1 μm and 10 μm.

Figure 5B:
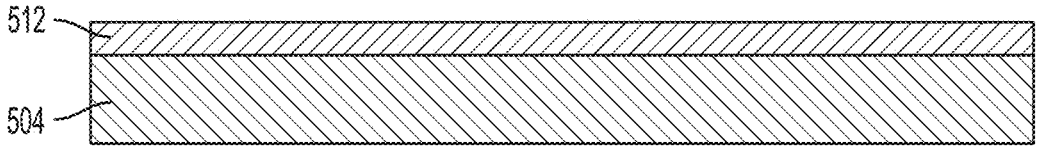
FIG. 5B is a side view of dried hydrophilic composition on the surface of the indirect image receiving member after a dryer removes a portion of a liquid carrier in the hydrophilic composition.

Process 700 continues as a dryer in the printer is operated to remove at least a portion of the liquid carrier in the hydrophilic composition to form a dried layer of the absorption agent on the image receiving surface (block 708) without reaching the boiling temperature for the humectant, which remains liquid. In the printers 10, 200, and 300 the dryer 96 applies radiant heat and optionally includes a fan to circulate air onto the image receiving surface of the drum 12 or belt 13. FIG. 5B depicts the dried layer of the absorption agent 512. The dryer 96 removes a portion of the liquid carrier, which decreases the thickness of the layer of dried layer that is formed on the image receiving surface. In the printers 10, 200, and 300, the thickness of the dried layer 512 is on the order of 0.1 μm to 3 μm in different embodiments, and between 0.1 to 0.5 um in the embodiments of the printers 10, 200, and 300.

The dried layer of the absorption agent 512 is also referred to as a "skin" layer. The dried layer 512 has a uniform thickness that covers substantially the portion of the image receiving surface that receives aqueous ink during a printing process. As described above, while the hydrophilic composition with the liquid carrier includes a solutions, suspension, or dispersion of the hydrophilic material in a liquid carrier, the dried layer of the absorption agent 512 forms a continuous matrix that covers the image receiving surface 504. As described in more detail below, when aqueous ink drops are ejected onto portions of the dried layer 512, a portion of the water and other solvents in the aqueous ink permeates the dried layer 512. The portion of the dried layer 512 that absorbs the liquid swells, but remains substantially intact on the image receiving surface 504.

Process 700 continues as the image receiving surface with the hydrophilic skin layer moves past one or more printheads that eject aqueous ink drops onto the dried layer and the image receiving surface to form a latent aqueous printed image (block 712). The printhead modules 34A-34D in the printers 10, 200, and 300 eject ink drops in the CMYK colors to form the printed image. When the water in the aqueous ink contacts the dried layer of the absorption agent that is formed on the image receiving surface, the dried layer rapidly absorbs the liquid water. Thus, each ink drop of the aqueous ink that is ejected into the image receiving surface expands as the absorption agent in the dried layer absorbs a portion of the water in the liquid ink drop. The absorption of water into the dried layer 512 also promotes binding between the aqueous ink and the absorption agent in the dried layer to "pin" or hold the liquid ink in a single location on the image receiving surface 504.

Figure 5C:
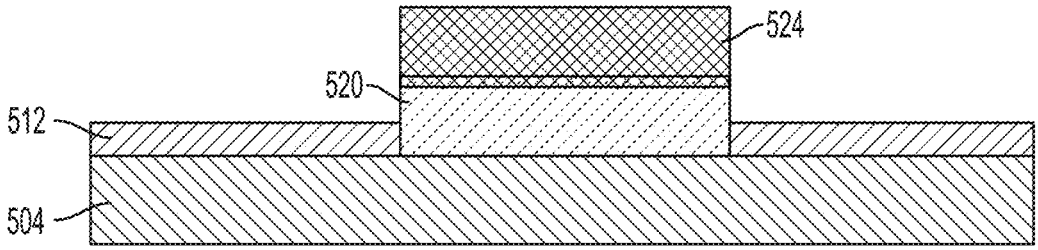
FIG. 5C is a side view of a portion of an aqueous ink image that is formed on the dried hydrophilic composition on the surface of the indirect image receiving member.

As depicted in FIG. 5C, the portion of the dried layer 512 that receives aqueous ink 524 absorbs water from the aqueous ink and swells, as is depicted by the region 520. The absorption agent in the region 520 absorbs water and other solvents in the ink and the absorption agent swells in response to absorption of the water and solvent. The aqueous ink 524 includes colorants such as pigments, resins, polymers, and the like. The absorption agent 512 is substantially impermeable to the colorants in the ink 524, and the colorants remain on the surface of the dried layer 512 where the aqueous ink spreads. Since the dried layer 512 is typically less than 1 μm in thickness, the absorption agent in the dried layer 520 absorbs only a portion of the water from the aqueous ink 524, while the ink 524 retains a majority of the water.

Figure 8:
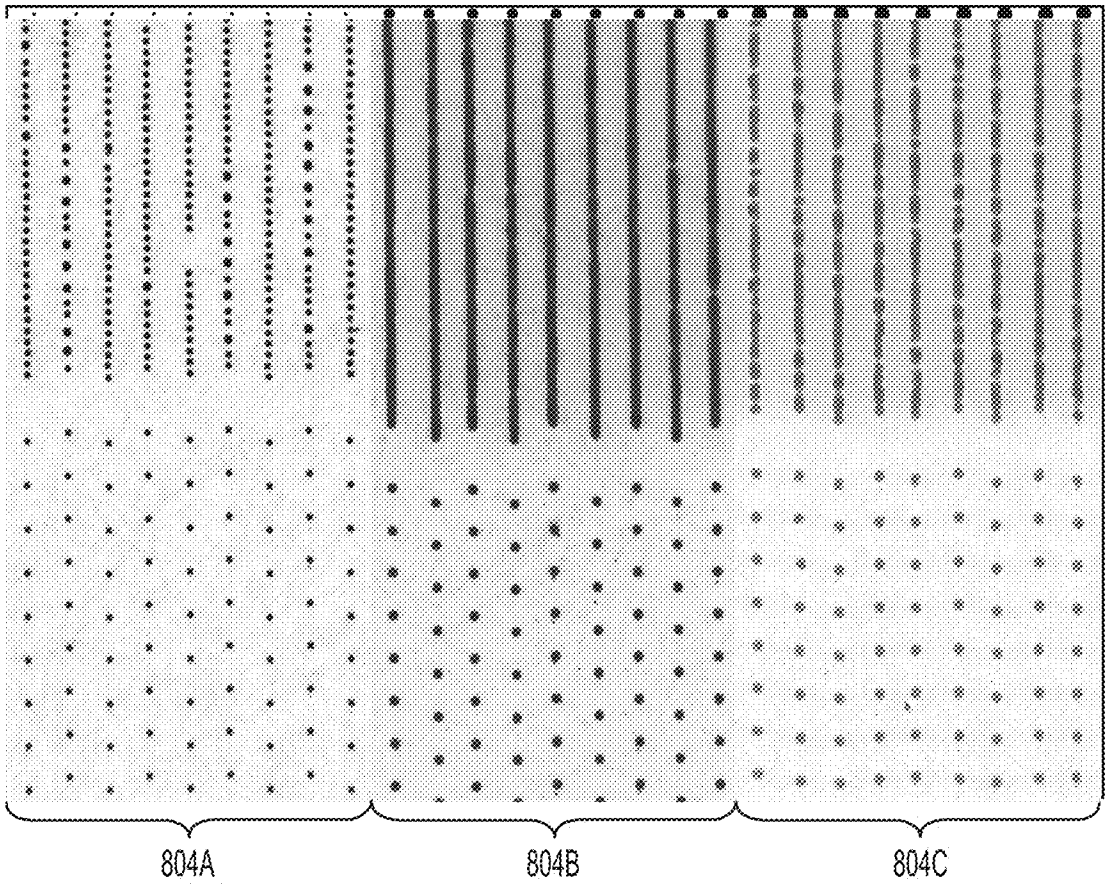
FIG. 8 is an illustration of ink drops that are formed on low-surface energy image receiving surfaces and ink drops that are formed on a layer of a hydrophilic composition that is formed on an indirect image receiving surface.

The spread of the liquid ink enables neighboring aqueous ink drops to merge together on the image receiving surface instead of beading into individual droplets as occurs in traditional low-surface energy image receiving surfaces. For example, FIG. 8 depicts examples of three printed patterns. FIGS. 804A-804B are images of aqueous ink drops that are transferred to a print medium. FIG. 804C shows the image of direct printing of aqueous inkjet onto a premium inkjet photo paper. The pattern 804A depicts ink drops that are formed on a bare image receiving surface with low-surface energy and then are transferred to ordinary paper. The low surface energy of the image receiving surface promotes the ink drops to "bead" or remain in the form of individual droplets instead of merging together. The pattern 804C depicts the printed ink drops that are jetted directly to a high-quality paper that is specifically coated for inkjet printing. The ink drops in the pattern 804C spread to a greater degree than the drops in the pattern 804A, but the paper absorbs a large proportion of the colorant in the ink quickly, which reduces the perceptible density of the ink. In addition, to promote spreading, the ink needs to be on top of the substrate and remain a low viscosity liquid for some more time. The quick and complete absorption of the ink drops limits the amount of spreading of the ink drops. As a result, the printed pattern still includes non-continuous lines. Prior art printers require larger amounts of ink to fill the gaps for higher-quality printing. The printed pattern 804B is formed using the hydrophilic skin in the printing process. As depicted in FIG. 8, the ink drops 804B spread because the absorption agent has a high surface energy that promotes spreading of the ink drops on the image receiving member. Furthermore, slow absorption of the water/solvent by the skin and the limited water absorption capacity of the skin give the ink more time to spread. Thus, the dried layer enables printing of solid lines and patterns as depicted in the pattern 804B using less ink than is required with previously known printers.

Referring again to FIG. 7, the process 700 continues with a partial drying process of the aqueous ink on the image receiving member (block 716). The drying process removes a portion of the water from the aqueous ink and the hydrophilic skin layer on the image receiving surface so that the amount of water that is transferred to a print medium in the printer does not produce cockling or other deformations of the print medium. In the printers 10 and 200, the dryer 136 directs both heat and air toward the image receiving surface 14 to dry the printed aqueous ink image. For example, in the printers 10 and 200, the imaging drum 12 and blanket 21 are heated to a temperature in the range of about 90° C. to about 150° C. to enable efficient partial drying of the ink during the printing process by removing a large amount of water and other co-solvent in the ink. The partially dried absorption agent in the area without ink, however, is also subjected to the same intense drying. In previously known printers, when the solid areas, which are large areas with ink, are dried to a tacky state suitable for transfer to media, the background areas 512, which are large areas without ink, the surface treatment coating becomes too dry and loses adhesion to the print medium. Thus, achieving an appropriate amount of dryness in the transition regions between inked and un-inked areas is very difficult and can easily become over-dried. As a consequence, the lack of transfer causes ink drop-out in the fine structures such as halftone dots, fine lines and sharp edges.

To improve transfer to the media and prevent the over-drying of the fine structures and halftones, a sufficient amount of a high boiling point humectant is introduced into the hydrophillic composition. In some embodiments, the image receiving member and blanket are heated to an elevated temperature to promote evaporation of liquid from the ink and the dried layer of the absorption agent, but the temperature remains significantly below the boiling point for the humectant so the humectant remains in the composition. The high boiling point humectant and the binder in the hydrophilic composition form a highly viscous and tacky layer that has a very strong adhesion to the substrate. As a result, all areas, including the image area, the halftone area, and the background area that contains the composition are in a state suitable for transfer. The reader should understand the condition suitable for transfer of skin in the background area is important for providing a robust measure that prevents the drop-out of fine image structures, such as halftone dots, in the transfer to the media. In some embodiments, the humectant constitutes 20% to 85% of the partially dried skin. In other embodiments, the humectant has 40% to 70% weighting in the skin before transfer.

Figure 5D:
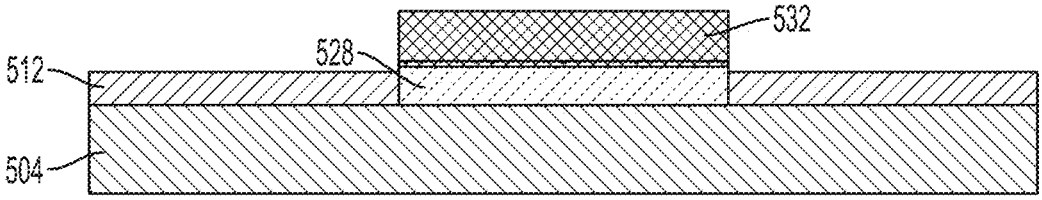
FIG. 5D is a side view of a portion of the aqueous ink image that is formed on the dried hydrophilic composition after a dryer in the printer removes a portion of the water in the aqueous ink, but the humectant remains in the hydrophilic composition on the surface of the indirect image receiving member.

The reader should note that liquid evaporates well below its boiling point due to its vapor pressure and air flow. For example, humectant with boiling point of 180° C. can be removed from the coating with sufficient airflow when the imaging surface reaches a temperature of 150° C., even though this temperature is well below its boiling point. In order to keep a significant amount of the humectant in the coating for improved transfer performance, as described in more detail earlier, in one embodiment, the maximum temperature of the ink and composition drying is greater than 50-100° C. below the boiling point of the high boiling point humectant. As an example, the boiling temperature of a humectant such as glycerol, which is 290° C., enables the drying temperature to remain well below the boiling point of the humectant. On the other hand, ethylene glycol with a boiling point of 197.3° C. can be used only if the drying temperature is carefully regulated. In some embodiments, humectant includes glycerol, various glycols (such as ethylene glycol, propylene glycol, and the like) or a mix of them. Thus, the humectant helps the composition to remain sufficiently tacky that it retains an affinity for the media passing through the nip. The printer 300 includes multiple dryers 35A-35D that dry the latent aqueous ink images on the surface of the belt 13 after each of the printhead modules 35A-35D eject aqueous ink drops, respectively. As depicted in FIG. 5D, the drying process forms a partially dried layer 528 and aqueous ink 532, both of which retain a reduced amount of water compared to the freshly printed aqueous ink image of FIG. 5C.

The drying process increases the viscosity of the aqueous ink, which changes the consistency of the aqueous ink from a low-viscosity liquid to a higher viscosity tacky material. In some embodiments, the absorption agent that absorbs a portion of the water in the aqueous ink also acts as a thickening agent that increases the viscosity of the aqueous ink. The drying process also reduces the thickness of the ink 532 and the portion of the absorption agent 528 that absorbed water from the ink 532. One common failure mode for transfer of aqueous ink images to print media occurs when the aqueous ink image splits. That is to say, only about half of the ink transfers to the print medium from the indirect image receiving surface, while the remaining portion of the ink image remains on the indirect image receiving member. The failure of ink transfer is typically caused by the low cohesion of ink image layer, because the ink layer has the weakest separation force at the exit of the transfer nip when the image receiving surface and the substrate surface are separating. To increase the efficiency of ink transfer, the cohesion of the ink layer or ink/skin composite layer should be significantly greater than the adhesion between the skin and the blanket surface. As is known in the art, the cohesion of the ink is proportional to the viscosity of the ink and inversely proportional to a cube of the thickness of the ink. Thus, the drying process greatly increases the cohesiveness of the aqueous ink. The materials in the ink 532 with the highest degree of cohesiveness include resins or polymers that do not permeate into the underlying absorption agent 528. The underlying layer of the absorption agent 528 separates the partially dried ink 532 from the image receiving surface 504, and the water content in the absorption agent 528 reduces the adhesion between the absorption agent 528 and the image receiving surface 504. Thus, the partially dried ink 532 and absorption agent 528 enable efficient transfer of the printed ink from the image receiving surface 504 to a print medium. Additionally, the high boiling point humectant and the binder in the partially dried hydrophilic composition form a highly viscous and tacky layer. As explained further below, this tacky property helps transfer the partially dried layer to the media, which aids in the preservation of the ink in halftone areas that are likely to be dryer than solid print areas.

Figure 5E:
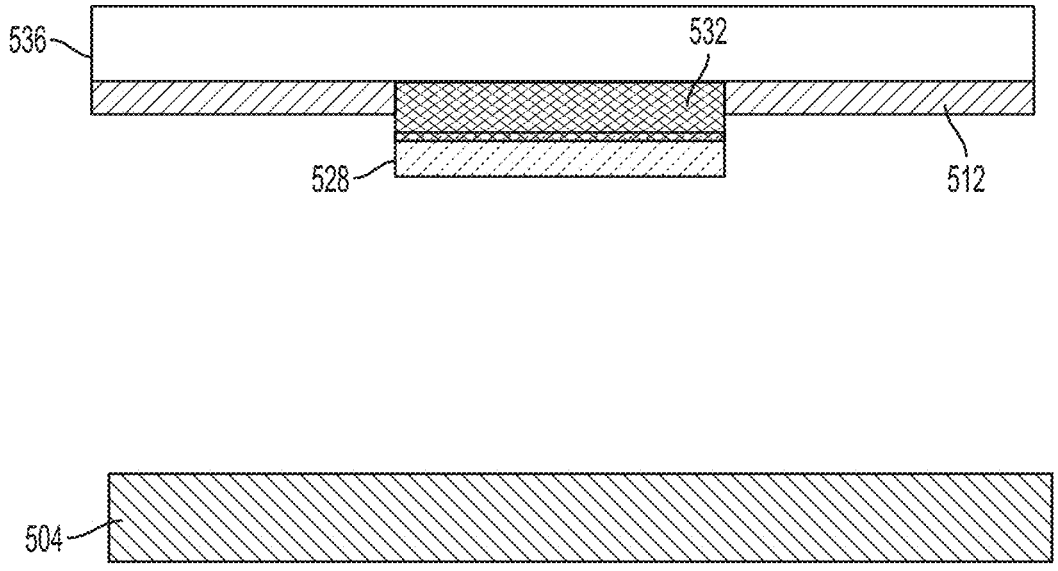
FIG. 5E is a side view of a print medium that receives the aqueous ink image and the dried layer of the hydrophilic composition with the humectant still in the composition after a transfix operation in the inkjet printer.

Process 700 continues as the printer transfers the latent aqueous ink image from the image receiving surface to a print medium, such as a sheet of paper (block 720). This transfer includes the partially dried ink and all areas containing the partially dried absorption agent with the humectant. In the printers 10 and 200, the image receiving surface 14 of the drum 12 engages the transfix roller 19 to form a nip 18. A print medium, such as a sheet of paper in the printer 10 or a continuous paper web in the printer 200, moves through the nip between the drum 12 and the transfix roller 19. In the printer 300, the belt 13 and a print medium 330 pass through a nip 318 that is formed by two pressure rollers 320 and 319. The latent ink image is transferred from the surface of the belt 13 and transfixed to the print medium 330 in the nip 318. The pressure in the nip transfers the latent aqueous ink image and a portion of the dried layer to the print medium. After passing through the transfix nip 18, the print medium carries the printed aqueous ink image. As depicted in FIG. 5E, a print medium 536 carries a printed aqueous ink image 532 with the absorption agent 528 covering the ink image 532 on the surface of the print medium 536. The absorption agent 528 provides protection to the aqueous ink image from scratches or other physical damage while the aqueous ink image 532 dries on the print medium 536.

As depicted in FIG. 5E, the aqueous ink and portions of the dried layer that absorb ink separate from the image receiving surface 504 in the transfix nip since the image receiving surface 504 has a low level of adhesion to the absorption agent 528 that is formed under the printed ink image 532. Also depicted in FIG. 5E, the dried layer 512 transfers from the image receiving surface 504 to the print medium 536 after completion of the transfix operation because the humectant enables the skin 512 to maintain a high adhesion to the print medium. As illustrated, both extreme cases, namely, the solid area 532 and background area 512, transfer well to the media. In areas with fine structures, such as halftones (not illustrated), the ink/skin materials reach a state intermediate of the two extreme cases and also transfer with good efficiency to the media.

During process 700, the printer cleans residual portions of the dried layer and ink from the image receiving surface after the transfixing operation (block 724). In one embodiment, a fluid cleaning system 395 uses, for example, a combination of water and a detergent with mechanical agitation on the image receiving surface to remove the residual portions of the absorption agent from the surface of the belt 13. The fluid cleaning system 395 uses, for example, a combination of water and a detergent to remove the residual portions of the absorption agent from the surface of the belt 13. In the printers 10 and 200, a cleaning blade 95, which can be used in conjunction with water, engages the blanket 21 to remove the residual absorption agent from the image receiving surface 14. The cleaning blade 95 is, for example, a polymer blade that wipes residual portions of the absorption agent from the blanket 21.

During a printing operation, process 700 returns to the processing described above with reference to block 704 to apply the hydrophilic composition having the high boiling point to the image receiving surface, print additional aqueous ink images, and transfix the aqueous ink images to print media for additional printed pages in the print process. The illustrative embodiments of the printers 10, 200, and 300 operate in a "single pass" mode that forms the dried layer, prints the aqueous ink image and transfixes the aqueous ink image to a print medium in a single rotation or circuit of the indirect image receiving member. In alternative embodiments, an inkjet employs a multi-pass configuration where the image receiving surface completes two or more rotations or circuits to form the dried layer and receive the aqueous ink image prior to transfixing the printed image to the print medium.

Figure 6A:
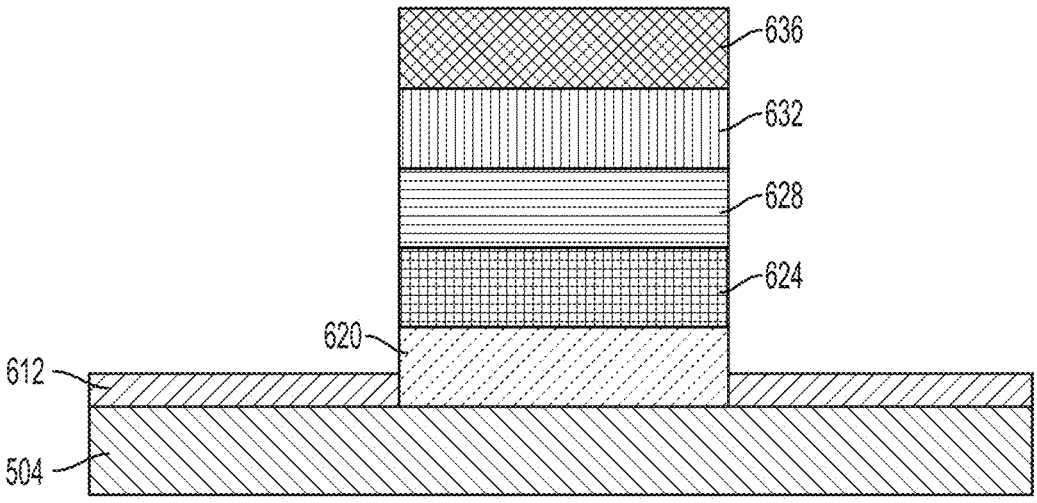
FIG. 6A is a side view of an image receiving surface that is covered with a dried layer of absorption agent during a multi-color printing process.

In some embodiments of the process 700, the printer forms printed images using a single layer of ink such as the ink that is depicted in FIG. 5A-FIG. 5B. In the printers 10, 200, and 300, however, the multiple printhead modules enable the printer to form printed images with multiple colors of ink. In other embodiments of the process 700, the printer forms images using multiple ink colors. In some regions of the printed image, multiple colors of ink may overlap in the same area on the image receiving surface. For example, FIG. 6A provides a diagram of the image receiving surface 504 with a dried layer of the absorption agent 612 and a swelled portion of the absorption agent 620. FIG. 6A depicts four printed layers of ink 624, 628, 632, and 636. In one embodiment, the ink layers 624-636 correspond to black, cyan, magenta, and yellow inks, respectively. The lowest layer of ink 624 is black ink, which is formed on the dried layer 612 before the other layers of ink, to enable the dried layer 612 to provide the highest quality spreading and drop retention to the black ink. In other configurations, the printer ejects different ink colors in an alternative order to form a portion of a printed image with a different color of ink on the absorption agent in the dried layer being formed first.

Figure 6B:
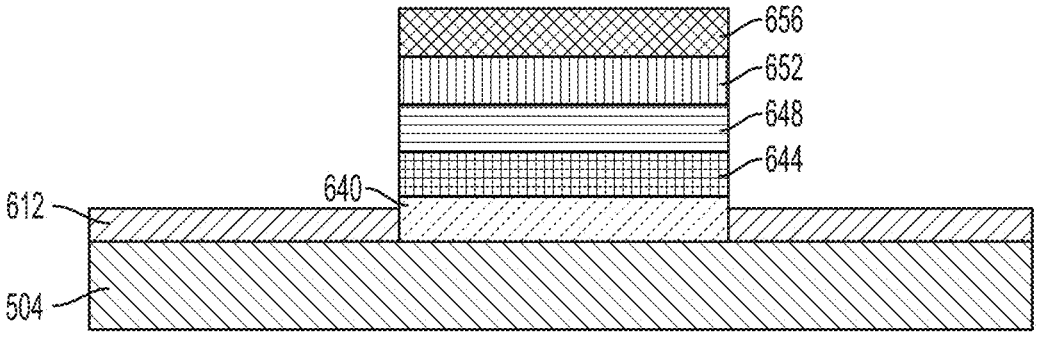
FIG. 6B is a side view of the image receiving surface of FIG. 6A after a partial drying process for a multi-colored ink image that is formed on the dried layer.
Figure 6C:
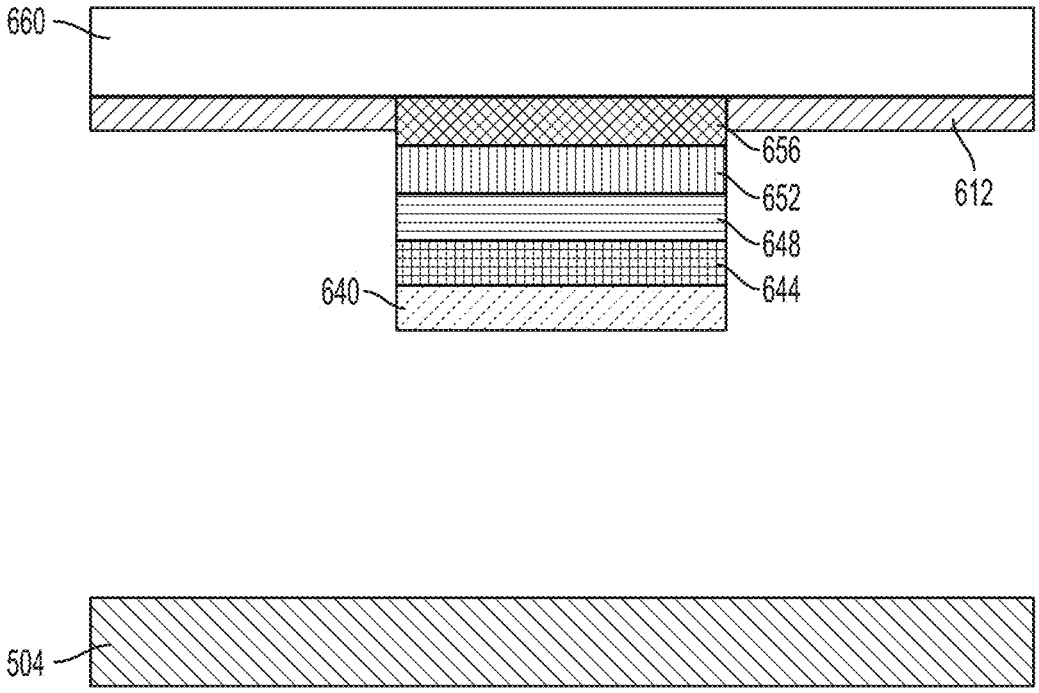
FIG. 6C is a side view of a print medium after transfer of the multi-colored printed image to the print medium.

As described above, the swelled absorption agent in the region 620 absorbs some of the water and other solvents in the liquid inks 624-636, but since the dried layer of the absorption agent is less than 1 μm in thickness, the liquid ink retains a majority of the water. In FIG. 6A, all four aqueous ink colors are printed on the image receiving surface 504 and dried layer 612 prior to the partial drying that is described in the process 700. FIG. 6B depicts the partially dried portion of the absorption agent 640 with layers of partially dried ink 644, 648, 652, and 656 corresponding to the black, cyan, magenta, and yellow inks, respectively. As depicted in FIG. 6C, the printer transfers the multi-colored partially dried ink layers 644-656, the dried absorption agent 640 and 612 with the humectant to a print medium 660 during the transfix process.

The multicolor printing embodiment of FIG. 6A-FIG. 6C corresponds to an embodiment of the process 700 where a printer forms multiple colors of ink on a single dried layer of the absorption agent before performing the partial drying process. In another embodiment, the printer performs partial drying of each ink color prior to ejecting another color of ink onto a single layer of the absorption agent that is formed on the image receiving surface. As depicted in FIG. 3, the printer 300 includes the dryers 35A-35D that perform partial drying after the ejection of ink from each of the printhead modules 34A-34D, respectively. In another embodiment of the process 700, the printer forms printed images in a multi-pass configuration. In the multi-pass configuration, the printer forms a single layer of the dried absorption agent, ejects a single color of ink, partially dries the ink, transfers the image to the print medium, and repeats the process described above for multiple ink colors to assemble the color image on the print medium through subsequent transfers. For example, in a CMYK printer, the printer performs up to four passes with each pass corresponding to the printing with one of the CMYK inks. In this process, the printer applies a new layer of the hydrophilic composition to the image receiving surface during each pass.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet printer comprising:

an indirect image receiving member having an image receiving surface configured to move in a process direction in the inkjet printer;

a surface maintenance unit having a reservoir containing a hydrophilic composition comprising a liquid carrier, a humectant, and an absorption agent to the image receiving surface, the surface maintenance unit being configured to apply the hydrophilic composition to the indirect receiving member at a predetermined thickness;

a dryer positioned and configured to direct air having a temperature that is below a boiling point of the humectant by at least 50 degrees Celsius towards the image receiving surface to remove at least a portion of the liquid carrier from the layer of hydrophilic composition after the surface maintenance unit has applied the hydrophilic composition to the image receiving surface to form a dried layer of the absorption agent;

a plurality of inkjets configured to eject aqueous ink onto the dried layer of the absorption agent to form an aqueous ink image on the image receiving surface of the image receiving member; and a transfix member that engages the image receiving member to form a transfix nip, the transfix member being configured to apply pressure to a print medium moving through the transfix nip as the aqueous ink image on the dried layer of absorption agent moves through the transfix nip to transfix the aqueous ink image, the dried layer of absorption agent that receives the aqueous ink, and the dried layer of absorption agent with the humectant to a surface of the print medium.

2. The inkjet printer of claim 1 wherein the liquid carrier is water.

3. The inkjet printer of claim 1 further comprising:

a cleaning unit positioned and configured to remove residual dried layer of absorption agent and ink from the image receiving surface that is not transferred to the print medium prior to the surface maintenance unit applying the hydrophilic composition to the image receiving surface.

4. The printer of claim 1 further comprising:

another dryer positioned and configured to direct air having a temperature below the boiling point of the humectant by at least 50 degrees Celsius to remove a portion of liquid solvent from the aqueous ink image formed on the dried layer of absorption agent.

5. The printer of claim 1, the surface maintenance unit further comprising:

a roller partially submerged in the reservoir and engaging the image receiving surface, the roller being configured to rotate in response to the movement of the image receiving member in the process direction to draw the hydrophilic composition having the humectant from the reservoir and form the layer of the hydrophilic composition with the humectant on the image receiving surface.

6. The printer of claim 1, the surface maintenance unit being configured to form the layer of the hydrophilic composition with the predetermined thickness being between 1 μm and 10 μm.

7. The printer of claim 1, the dryer being configured to remove the portion of the liquid carrier from the layer of hydrophilic composition to form the dried layer of absorption agent with a thickness of the absorption agent being between 0.1 μm and 1 μm.

8. The printer of claim 1, the dryer being further configured to heat the air to a temperature in a range of about 50 to about 100 degrees Celsius below a boiling point of the humectant.

9. The printer of claim 1, the plurality of inkjets further comprising:

a first plurality of inkjets configured to eject aqueous ink of a first color onto the dried layer; and a second plurality of inkjets configured to eject aqueous ink of a second color onto the dried layer after the first plurality of inkjets eject the aqueous ink of the first color.

10. The printer of claim 9 further comprising:

a first dryer positioned the first plurality of inkjets and the second plurality of inkjets, the first drying being configured to direct air having a temperature at least 50 degrees Celsius below the boiling point of the humectant to remove a portion of liquid solvent from the aqueous ink of the first color formed on the dried layer by the first plurality of inkjets before the second plurality of inkjets eject aqueous ink of the second color onto the ink of the first color; and a second dryer positioned and configured to direct air having a temperature at least 50 degrees Celsius below the boiling point of the humectant to remove a portion of liquid solvent from the aqueous ink of the first color and the aqueous ink of the second color formed on the dried layer after the second plurality of inkjets has ejected the aqueous ink of the second color onto the dried layer.

11. The printer of claim 1 wherein the humectant is glycerol, ethylene glycol, propylene glycol, or a mixture of glycerol with either ethylene glycol or propylene glycol.

12. The printer of claim 1, the absorption agent in the dried layer further comprising:

a material that swells in response to absorption of the liquid solvent from the aqueous ink.

13. The printer of claim 12 wherein the absorption agent in the dried layer is substantially impermeable to colorant in the aqueous ink.

14. The printer of claim 1 wherein the humectant is about 20 percent to about 85 percent of a mass of the dried layer.

15. The printer of claim 1 wherein the humectant is about 20 percent to about 85 percent of a volume of the dried layer.

16. The printer of claim 1, wherein the dried layer of absorption agent is configured to enable a portion of a liquid solvent in the aqueous ink to permeate a region of the dried layer of absorption layer that receives the aqueous ink to reduce a level of adhesion between the region of the dried layer of absorption layer and the image receiving surface.

17. A method of operating an inkjet printer comprising:

moving an image receiving surface of an indirect image receiving member in a process direction through the inkjet printer past a surface maintenance unit, a dryer, a plurality of inkjets, and a transfix nip;

applying a layer of hydrophilic composition comprising a liquid carrier, a humectant, and an absorption agent to the image receiving surface with the surface maintenance unit, the layer of hydrophilic composition on the image receiving surface having a predetermined thickness;

drying the layer of hydrophilic composition with air from the dryer having a temperature that is at least 50 degrees Celsius below a boiling point of the humectant to remove at least a portion of the liquid carrier from the layer of the hydrophilic composition to form a dried layer of the absorption agent on the image receiving surface;

ejecting ink drops of an aqueous ink with the plurality of inkjets to form an aqueous ink image on the dried layer of the absorption agent; and applying pressure with a transfix member to the image receiving surface of the indirect image receiving member to transfix the aqueous ink image, the dried layer that receives the aqueous ink, and the dried layer of the absorption agent with the humectant to a surface of a print medium moving through the transfix nip between the transfix member and the indirect image receiving member.

18. The method of claim 17 wherein the liquid carrier in the applied hydrophilic composition is water.

19. The method of claim 17 wherein the humectant in the applied hydrophilic composition is glycerol, ethylene glycol, propylene glycol, or a mixture of glycerol with either ethylene glycol or propylene glycol.

20. The method of claim 17 further comprising:

moving the image receiving surface in the process direction past another dryer located between the plurality of inkjets and the transfix nip; and drying the aqueous ink image with air from the other dryer having a temperature at least 50 degrees Celsius below the boiling point of the humectant to remove a portion of liquid solvent from the aqueous ink image formed on the dried layer of absorption agent.

21. The method of claim 17 further comprising:

applying the layer of the hydrophilic composition to the image receiving surface with a roller in the surface maintenance unit that rotates in response to the movement of the image receiving surface and draws the hydrophilic composition and humectant from a reservoir to form the layer of hydrophilic composition on the image receiving surface at the predetermined thickness.

22. The method of claim 17 further comprising:

heating the air that dries the layer of hydrophilic composition to a temperature that is in a range of about 50 degrees Celsius to about 100 degrees Celsius below the boiling point of the humectant.

23. The method of claim 17 wherein the humectant is about 20 percent to about 85 percent of a mass of the dried layer.

24. The method of claim 17 wherein the humectant is about 20 percent to about 85 percent of a volume of the dried layer.

* * * * *